US005088261A

United States Patent [19]

Mieyal et al.

[11] Patent Number: 5,088,261

[45] Date of Patent: Feb. 18, 1992

[54] CURVED GRID TEES FOR SUSPENSION CEILINGS

[75] Inventors: David F. Mieyal, Strongsville; James A. Fletterick, Olmsted Falls, both of Ohio

[73] Assignee: USG Interiors, Inc., Chicago, Ill.

[21] Appl. No.: 631,337

[22] Filed: Dec. 20, 1990

[51] Int. Cl.[5] ..... E04C 3/00

[52] U.S. Cl. ..... 52/729; 52/484; 52/665; 52/667

[58] Field of Search ..... 52/665, 664, 488, 484, 52/729, 248, 249

[56] References Cited

U.S. PATENT DOCUMENTS

| | | | |
|---|---|---|---|
| 3,189,139 | 6/1965 | Znamirowski et al. | 52/729 |
| 4,083,153 | 4/1978 | Sumpter . | |
| 4,206,578 | 6/1980 | Mieyal | 52/484 |
| 4,291,081 | 9/1981 | Olez | 52/729 |
| 4,531,340 | 7/1985 | Saver | 52/726 |
| 4,545,170 | 10/1985 | Shirey | 52/670 |
| 4,648,230 | 3/1987 | Mieyal et al. | 52/667 |
| 4,679,375 | 7/1987 | Shirey | 52/475 |
| 4,783,946 | 11/1988 | Boegle . | |
| 4,835,921 | 6/1989 | Baggett, Jr. et al. | 52/220 |
| 4,932,170 | 6/1990 | Spear . | |

*Primary Examiner*—David A. Scherbel
*Assistant Examiner*—Wynn Wood
*Attorney, Agent, or Firm*—Pearne, Gordon, McCoy & Granger

[57] ABSTRACT

A horizontally curved grid tee for suspension ceilings is bent in the direction parallel to the plane of the flanges of the grid tee. Such grid tee is provided with end connectors and openings so that the grid tee can be assembled in a suspension ceiling grid combining curved grid tees and/or straight grid tees to produce aesthetically pleasing patterns. When panels are installed in the openings defined by the curved grid tees, appropriate mating curves are formed in the panels so that the panels are supported at their periphery. A method and apparatus for producing such grid tees involves curved tooling which cooperates to confine a straight grid tee as it is bent to the curved shape. The tooling provides grooves into which the flanges project during the bending operation. Such grooves are constructed and dimensioned so that the inner portion of the flange which is subjected to compressive stresses is not buckled. Such tooling allows the production of curved grid tees having a planar smooth flange in which the exposed surface coating applied as a prepainting operation is not damaged.

20 Claims, 8 Drawing Sheets

CURVED GRID TEES FOR SUSPENSION CEILINGS

BACKGROUND OF THE INVENTION

This invention relates generally to suspension ceilings formed of interconnected grid tees, and more particularly to a novel and improved curved grid tee, to a grid containing such curved grid tee, and to a method and apparatus for producing such curved grid tee.

PRIOR ART

Suspension ceiling grids formed with straight grid tees having an inverted "T" shape are well known. Such grid tees are often formed of elongated strips of sheet metal which are roll-formed. Generally, one strip of sheet metal is formed to provide a central, vertically extending web, a stiffening bulb along the upper edge of the web, and flange portions extending laterally in both directions from the lower extremity of the web. In some instances, a second strip of sheet metal providing a flange cap is positioned along the lower surface of the flange portions of the first piece, and is secured thereto by reverse bends extending around the edges of the flange of the first piece. In such grid tee, the two strips cooperate to form the flanges of the finished grid tee, and the cap or second strip is provided with a smooth, planar, exposed lower surface. Further, it is typical to prepaint the stock for the exposed cap so that post-painting is not required.

It is also known to form grid tees by extrusion. Further, it is known to form vertically curved grid tees which are curved in a plane normal to the width of the flange. Such vertically, upwardly curved tees are produced by producing tapered crimps in the web and bulb to shorten the web, causing the web to curve upwardly. Because this produces a curve in a direction normal to the width of the flange, the smooth character of the flange remains even though the flange is convexly curved. For downwardly curved grid providing a concavely curved flange, a process has been employed in which the web has been swaged to reduce its thickness and increase its length. Here again, the curve is in a plane normal to the flange width and a smooth exposed web surface remains.

It is also known to form a grid with an L-shape boundary member, as disclosed in U.S. Pat. No. 3,159,251. This patent discloses an L-shaped grid element having a lateral flange which extends in only one direction from the vertical web. Such flange is cut at longitudinally spaced intervals, and is encased within a stretchable cover. Such cuts allow the grid element to be bent, and thereby curved, in one direction and the flexible web stretches, to accommodate the curvature.

SUMMARY OF THE INVENTION

The present invention provides grid tees that are horizontally curved in a direction parallel to the plane of the flange. Such members can be installed in grids with other curved members and typical straight grid members to produce an unlimited number of grid patterns. The curved grid members provide end connectors and connector openings along their length so that they can be assembled and connected in the same way that typical straight grid members are assembled and connected.

In accordance with one aspect of the present invention, a novel and improved method and apparatus are provided for producing horizontally curved grid from straight strips of sheet metal. In the illustrated embodiment, two strips of sheet metal are first roll-formed in a conventional manner to produce straight grid tees. One strip, herein referred to as the "body" or "body strip," is roll-formed to provide a central web, an integral stiffening bulb along the upper edge thereof, and oppositely extending flange portions along the lower edge of the web. The other strip or "cap" is positioned against the lower face of the flange portions, and is secured to the body strip by reverse bends extending along the outer edge of the body flange portion. Normally, the cap strip is prepainted to eliminate post-painting operation, and provides a smooth, planar, exposed surface for the grid tee.

End connectors are provided at the ends of the grid tee either as an integral part of the web or as a separate end connector secured to the ends of the grid tee web. Also, compatible connector openings are provided at intervals along the web, permitting the grid tee to be interconnected to form a grid.

Such straight grid tees are well known to persons skilled in the art, and are regularly produced and sold throughout the world by a number of manufacturers. Therefore, the method and apparatus for producing such grid tees are not illustrated or specifically described herein.

In accordance with the invention, however, such grid tees are then formed into a horizontally curved shape in which the curve is in a direction parallel to the plane of the flange. The finished curved grid tee provides a planar flange, allowing the curved grid tees to be assembled in a grid having a planar, exposed surface.

In the illustrated method and apparatus, a straight grid tee is bent to a curved shape in dies which fit the grid profiles. As the grid tee is bent, the flange portion along the outer side of the curve is stretched and the flange portion along the inner side of the curve is subjected to compressive stresses and its length is shortened.

In order to prevent buckling of the inner portion of the flange, the dies are formed with a groove into which the inner flange portion moves during the bending operation. This groove is provided with a width sized to laterally confine the inner flange portion a sufficient amount to prevent buckling of at least the exposed surface of the inner flange portion. Also, the finished groove surface is smooth enough to allow such bending without damaging the prepainted flange surface. The outer flange portion is also confined during the bending operation to ensure that it remains flat and planar as it is stretched.

It is also an important aspect of this invention to provide a novel and improved horizontally curved grid tee for suspension ceilings which can be assembled with other grid tees and/or straight grid tees to form a variety of patterns. Such curved grid tees can be connected with other curved and straight grid tees. In some instances, the curved grid tee is assembled on one or both sides of a grid tee which extends through the intersection. In other instances, in which the two curved grid tees are connected together at their ends, an end connector is provided which does not require and intersection.

It is still another aspect of this invention to provide a novel and improved suspension ceiling grid system in which the grid is assembled utilizing horizontally curved grid members to define panel openings at least some of which have curved portions in combination with ceiling panels having curved portions which mate with the curved portions of such openings.

Such grids can be assembled in a great variety of patterns. Several examples of such patterns are illustrated.

These and other aspects of this invention are illustrated in the accompanying drawings and described in the following specification.

DETAILED DESCRIPTION OF THE DRAWINGS

Figure 1:
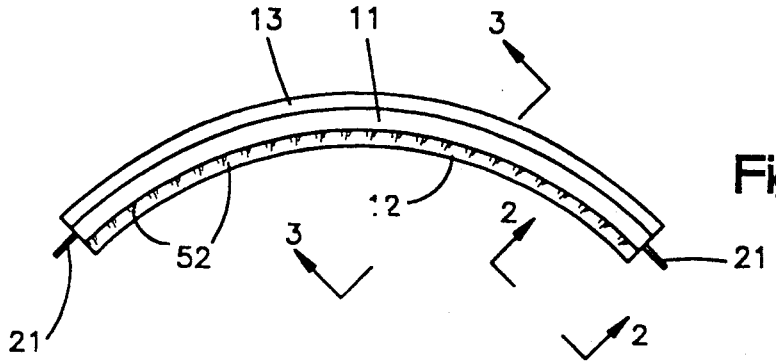
FIG. 1 is a plan view of a curved grid tee for suspension in ceilings incorporating the present invention.
Figure 2:
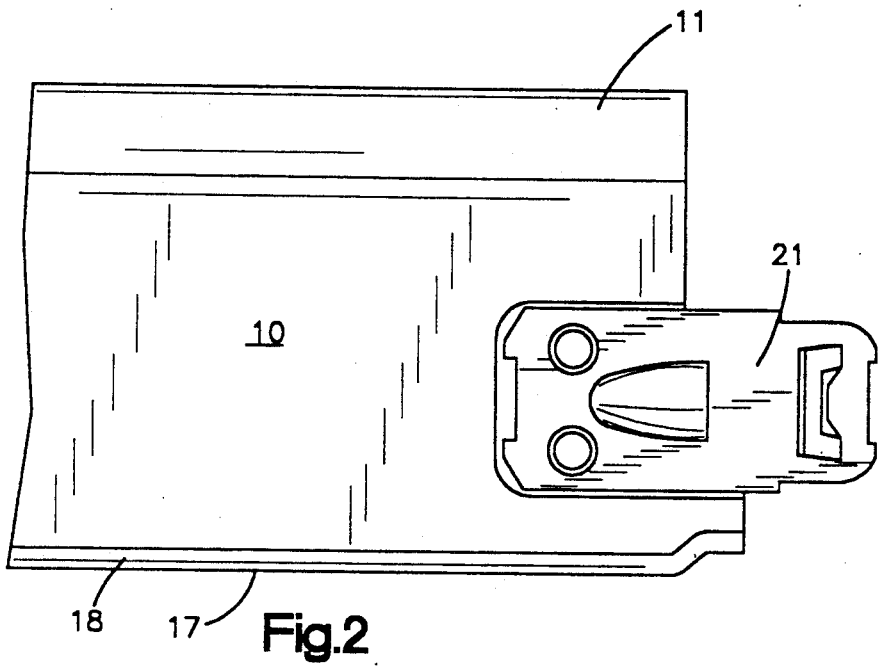
FIG. 2 is an enlarged, fragmentary view, taken along line 2—2 of FIG. 1, illustrating the end of the grid tee of FIG. 1 with an end connector mounted thereon.
Figure 3:
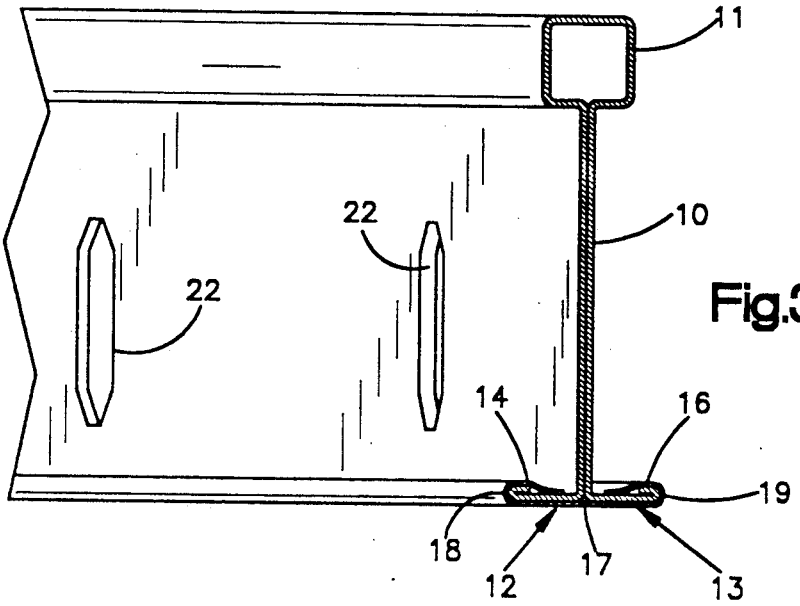
FIG. 3 is an enlarged, fragmentary view, taken along line 3—3 of FIG. 1, illustrating the cross section of the grid tee and connector openings at intervals along the web thereof.

FIGS. 1 through 3 illustrate the structural detail of a curved grid tee incorporating the present invention. Such grid tee is formed of two strips of sheet metal which are roll-formed into an inverted "T"-shape. One strip is roll-formed to provide a body portion having a double-layered, central web 10, a closed, generally rectangular stiffening bulb 11 at the upper end of the web 10, and oppositely extending flange portions 12 and 13 at the lower edge of the web 10. The two flange portions 12 and 13 are formed with reverse bends 14 and 16, respectively, at their outer edges to concentrate material adjacent to such edges for increased strength. A second strip of metal forming a cap 17 is positioned adjacent to the underside of the two flange portions and is secured thereto by reverse bends 18 and 19. Normally, the cap 17 is prepainted so that it provides an attractive lower surface for the grid tee.

Figure 4:
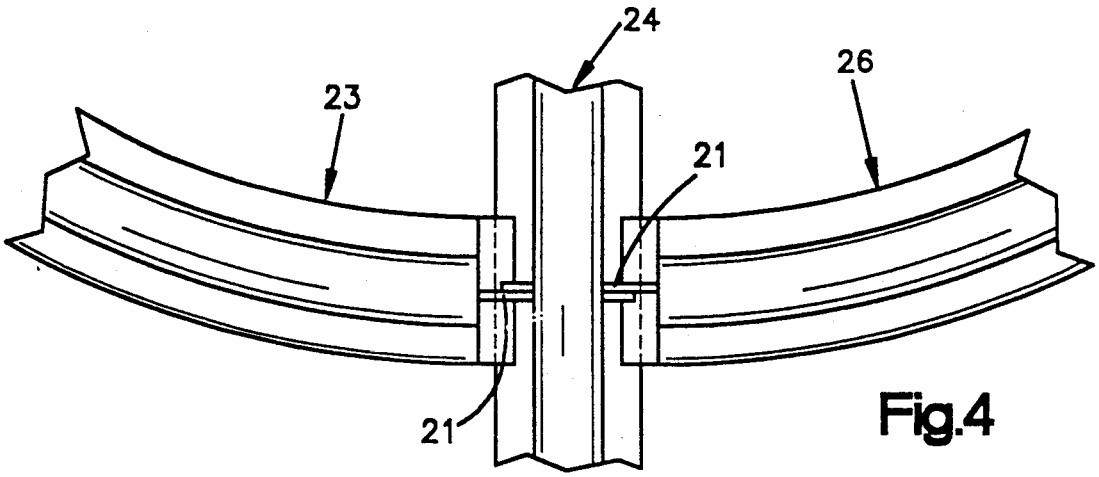
FIG. 4 is a plan view of an intersection between a pair of interconnected, curved grid tees and a straight grid tee extending therethrough.
Figure 5:
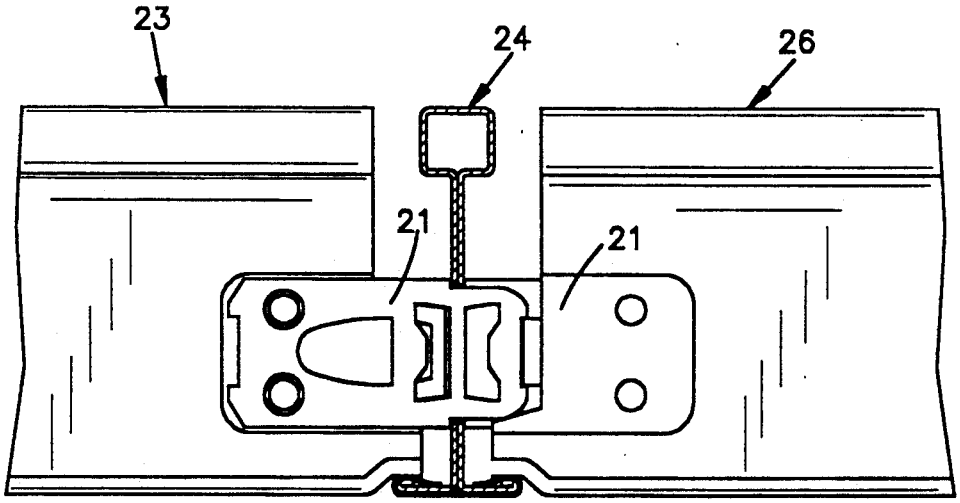
FIG. 5 is a side elevation of the intersection illustrated in FIG. 6.
Figure 6:
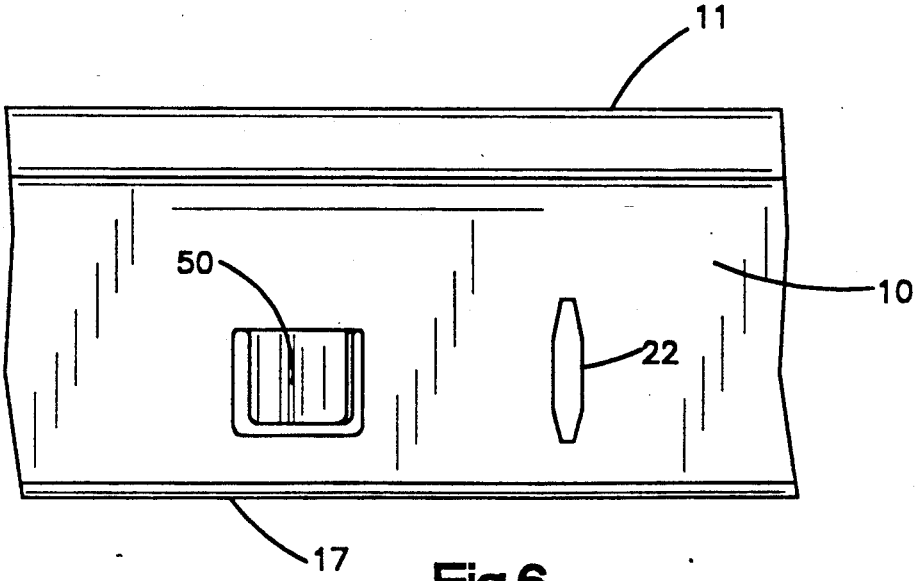
FIG. 6 is a side elevation of one of the connector openings formed in the web of the grid tee through which connectors can be assembled and a panel centering tab which may be provided in some instances.

The cross section thus far described is a typical cross section provided by conventional roll-formed, straight grid tees. In the present case, however, the grid tee is formed with a horizontal curve, best illustrated in FIG. 1, in which the inner flange portion 12 forms the inner side of the curve and the outer flange portion 13 forms the outer side of the curve. Mounted on the two ends of the grid are end connectors 21 and located at intervals along the length of the web are connector openings 22 (illustrated in FIGS. 3 and 6). These permit the grid tees to be interconnected at intersections to form an assembled suspension ceiling grid, as best illustrated in FIGS. 4 and 5.

In such illustrated intersection, a first curved grid 23 is connected on one side of a through-grid 24 and another curved grid tee 26 is connected on the other side of the through-grid tee 24. In such illustrated intersection, the grid tee 24 is a straight grid tee; however, intersections can also be formed in which the through-grid 24 is a curved grid and the oppositely connected grids 23 and 26 are either curved or straight.

The particular end connector 21 and connector opening 22 illustrated are disclosed and claimed in U.S. Pat. No. 4,108,563. Such end connector provides a first end-in lock and a connector-to-connector lock. The first end-in lock provides an interconnection between each of the grid tees 23 and 26 and the through-grid tee 24. Therefore, a locking connection is provided if only one grid tee is connected to the through-runner. The connector-to-connector lock provided by such structure also interconnects the two end connectors 21 which extend in opposite directions through the connector opening 22.

Reference may be made to U.S. Pat. No. 4,108,563 for a detailed description of the structure and operation of the illustrated connector clip, and such patent is incorporated in its entirety herein for that purpose.

It should be understood, however, that other forms of connectors may be utilized, and that this invention is not limited to a particular end connector structure illustrated. For example, the end connector can be formed as an integral extension of the web 10, as illustrated in U.S. Pat. No. 3,501,185. Similarly, in instances in which the ends of the grid tees are to be connected together at locations where a through-grid tee member does not exist, an end connector having the structure and connecting characteristic as illustrated in U.S. Pat. Nos. 3,197,345 or 4,531,340 may be used. In any case, end connectors should be provided so that the grid tees can be interconnected with other grid tees to form a suspension ceiling grid system.

Figure 8:
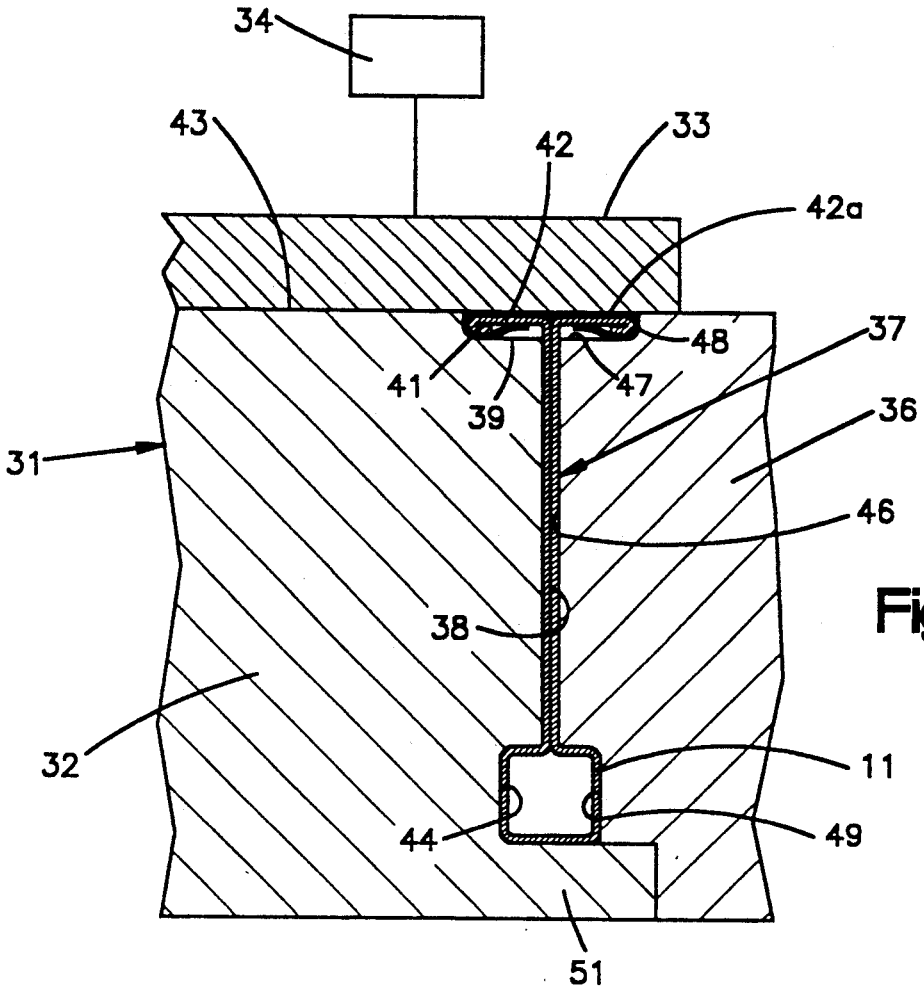
FIG. 8 is a greatly enlarged, fragmentary section, taken along 8—8 of FIG. 7.
Figure 7:
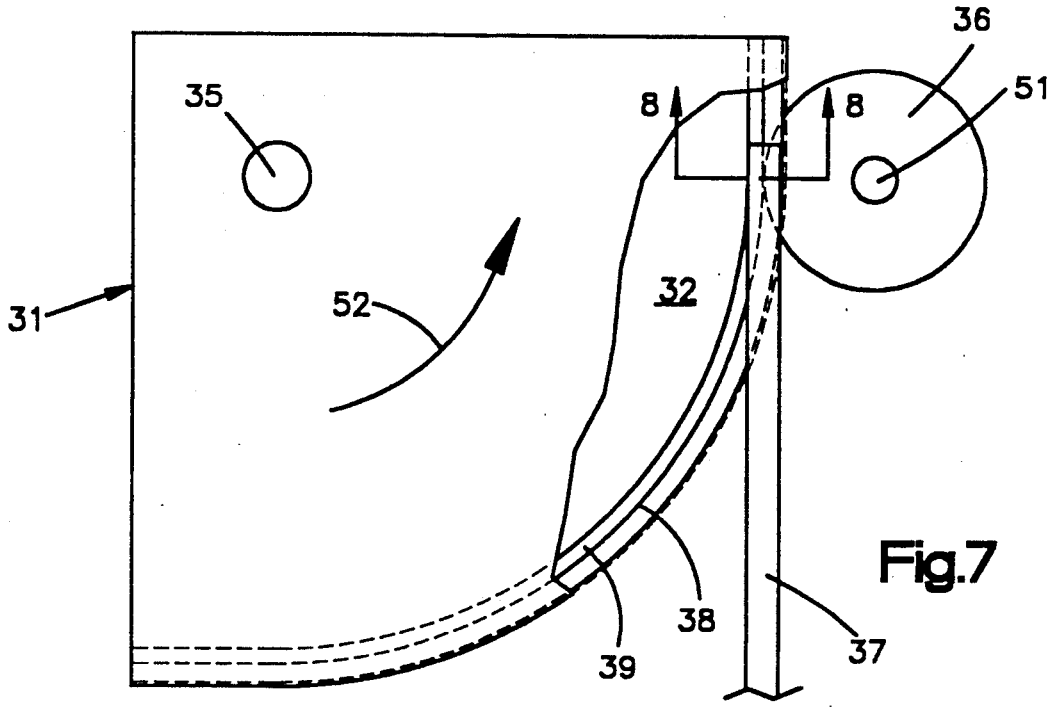
FIG. 7 is a plan view of one form of tooling which may be used to produce the grid tee of FIG. 1, with parts broken away to better illustrate the structural detail thereof.

In accordance with the present invention, the curved grid tees are formed in a die set or tool set which functions to bend a straight grid tee of conventional structure to the desired curved shape. FIGS. 7 and 8 illustrate one form of tooling to perform a bending operation. Such tooling provides an inner tool assembly 31 consisting of a lower member 32 and an upper plate 33. The upper plate is releasably clamped to the lower member by a schematically illustrated actuator 34. The actuator operates when clamped to secure the upper plate to the lower member so that they function as a single unit. The tooling also includes a roller 36.

The lower member 32 is provided with a curved periphery, which in the illustrated tooling extends through an arc of 90 degrees around a pivot axis 35. Such periphery is formed to mate with the cross section of a grid tee 37. It provides an arc segment or peripheral wall 38 proportioned and positioned to engage the web along the inner side of the curve which is formed by the tooling. At the upper end of the peripheral wall 38, the lower member 32 is provided with a recess 39 extending inwardly to a curved wall 41 positioned to engage the inner extremity of the inner flange portion 42. The upper plate 33 is clamped against the upper surface 43 of the lower member 32 and, in cooperation with the recess 39, forms a groove which receives the inner flange portion 42 during the bending operation. Below the peripheral wall 38, the lower member 32 is formed with a second groove 44 proportioned to receive one side of the bulb 11 of the grid.

The periphery of the roll 36 is shaped to mate with the outer side of the grid tee 37 and cooperate with the inner tool assembly 31 to complete the confinement of the grid tee 37. The roll also provides a peripheral surface 46 spaced from the peripheral surface 38 by a distance substantially equal to the thickness of the web 10. Adjacent the upper edge of the roll is a recess 47 extending to an outer circular wall 48 which cooperates with the upper plate 33 to form a groove to receive the outer flange portion 49 of the grid tee 37. Below the wall portion 46, the roll 36 is formed with a recess 49 which cooperates with a flange 51 on the lower member 32 to confine the outer portion of the bulb 11. The roll 36 is journaled for rotation about a pivot axis 51 a fixed distance from the pivot axis 35 of the inner tool assembly 31.

During the bending operation, a straight grid tee 37 is inserted between the roller 36 and the lower tool assembly 31, while the upper plate is released to allow such insertion of the end of the straight grid tee 37 to the position illustrated in FIG. 7. The actuator 34 is then operated to clamp the upper plate 33 into tight engagement with the lower member 32. It is necessary to clamp the inserted end of the grid tee in place so that it is held in a fixed position relative to the tool assembly 31 as it is rotated relative to the roller during bending. Clamp means are provided by a clamping projection on the plate 33 which tightly grips the end of the grid against the lower member 32 so that the forward end of the grid is tightly clamped in the tool assembly 31 and held in place as the bending progresses. The bending operation is then performed by rotating the tool assembly 31 relative to the roller 36 in an anticlockwise direction (as indicated by the arrow 52) through a 90-degree arc. This causes the straight grid tee to be carried between the roller 36 and the tool assembly 31, and results in the straight grid tee's being curved through a 90-degree arc.

Such bending causes the outer flange portion **42*a* to be subjected to tensile stress and be stretched. Conversely, the inner flange portion 42 is subjected to substantial compressive stress and is caused to be reduced in length. In order to prevent such compressive stresses from causing buckling of the inner flange portion 42, the recess 39 is formed with a depth such that the groove formed by the recess in cooperation with the upper plate member is provided with a thickness less than the thickness of the original inner flange portion 42. Consequently, the inner flange portion, as it is forced into the groove formed by the recess 39 in cooperation with the upper plate 33, is prevented from buckling. By properly selecting the thickness or depth of the groove formed by the recess, the outer face of the inner flange portion remains smooth and planar as the bending occurs, even though such flange portion is subjected to very substantial compressive stresses. The depth of the recess 47, however, need not be selected to provide such tight compression of the outer flange portion 42*a*, since the tensile stresses formed therein do not tend to produce a similar type of buckling. After the bending operation is completed, the actuator 34** releases the clamping of the upper plate member and the grid tee can be removed from the tooling.

In practice, it has been established that the exterior surface of the cap 17 remains completely smooth and that when the surfaces of the various tools are sufficiently polished, the painted surface thereof is undamaged. It has been found, however, that slight wrinkles 52 (illustrated in FIG. 1) occur along the inner edge of the reversely bent cap along the surface of the inner flange portion adjacent to the central web 10. However, in an assembled ceiling grid, such wrinkles are hidden from view.

When producing relatively large radii of curvature, it is possible to form curved grid having a smooth, planar flange surface by utilizing two rollers having peripheral shapes similar to the shapes of the tooling when suitable entrance and exit guides are provided. Normally, however, tooling of the type illustrated in FIGS. 7 and 8 is preferred when relatively small radii of curvature in the order of 12 inches are required.

The illustrated embodiment utilizes a grid profile having a relatively narrow flange face when producing curved grid, since the problem of flange buckling tends to be a function of the width of the flange. When using relatively narrow-faced grid tees, laterally extending centering tabs 50 (illustrated in FIG. 6) of the type disclosed in U.S. Pat. No. 4,679,375 are provided to ensure that ceiling panels installed in the assembled grid are properly centered in each of the openings. Such patent is hereby incorporated by reference to more fully describe such centering tabs.

It should be understood that the prevent invention, in its broader aspects, also contemplates the production of horizontally curved grid tees which do not include a separate cap member. Still further, grid tees having wider flanges, and which do not require panel centering means, are within the broader aspects of this invention.

Figure 9A:
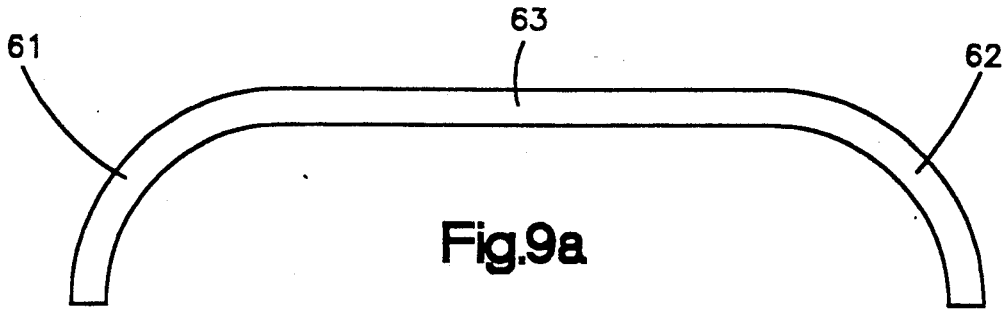
FIG. 9*a* illustrates one form of curved grid tees having a straight center portion and curved ends.

FIGS. **9*a* and 9*b* illustrate a grid tee having a straight central portion 63 and curved ends 61 and 62 which cooperate to form a generally "U"-shaped element. FIG. 9*a* illustrates a generally "S"-shaped grid having a straight central portion 63*a* and oppositely directed curved portions 61***a* and 62*a*. The grid tees of FIGS. 9*a* and 9*b* can be assembled in grids to function as main tees of a grid system. Further, they can be interconnected in subassemblies before being suspended.

Figure 9B:
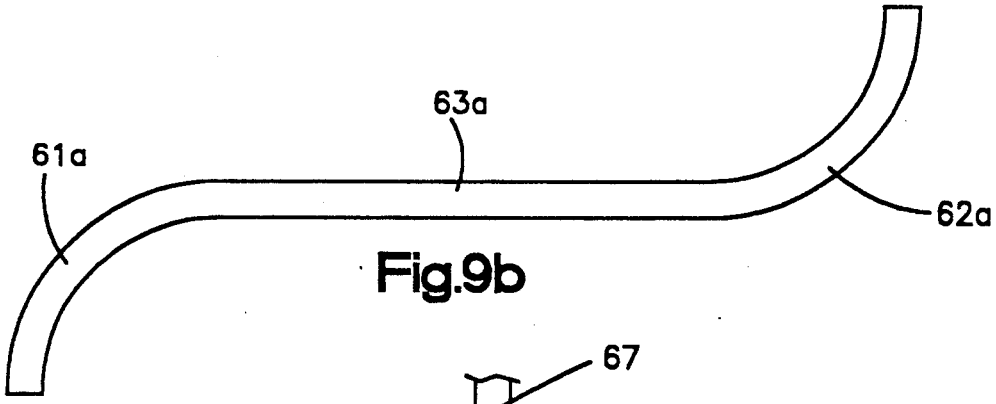
FIG. 9*b* illustrates another form of curved grid tees having a straight center portion and oppositely directed curved ends.
Figure 9C:
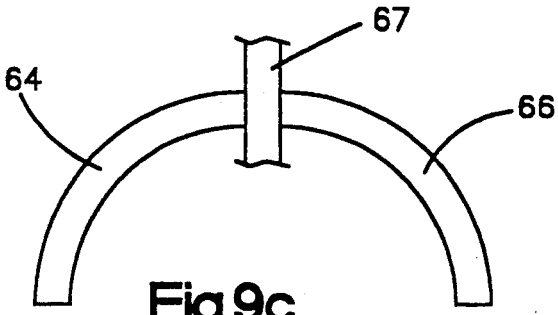
FIG. 9*c* illustrates an intersection between two curved grid tees assembled on opposite sides of a straight grid tee.

FIG. 9*c* illustrates a typical intersection connection in which two curved grid tees 64 and 66 are connected on opposite sides of a through, straight grid tee 67. In such instances, the curved grid tees 64 and 66 may be provided with end connectors which can be assembled through an opening such as the connector opening 22 illustrated in FIG. 6.

Figure 9D:
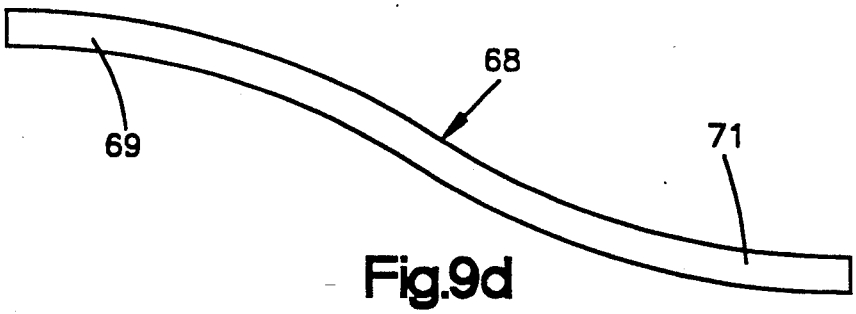
FIG. 9*d* illustrates a reversely curved grid tee.

FIG. 9*d* illustrates a reversely curved grid tee 68 having one end portion 69 curved in one direction and an opposite end portion 71 curved in the opposite direction. In such instances, the ends of the grid tee 68 are parallel but offset from each other.

Figure 9E:
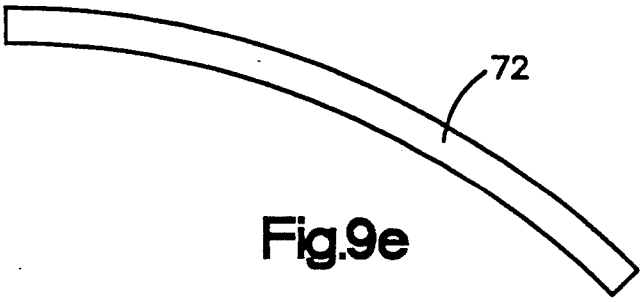
FIG. 9*e* illustrates a grid tee formed with a relatively large radius of curvature.

FIG. 9*e* illustrates a grid tee 72 which is formed with a relatively large radius of curvature and which does not extend through a full 90-degree arc.

Figure 10:
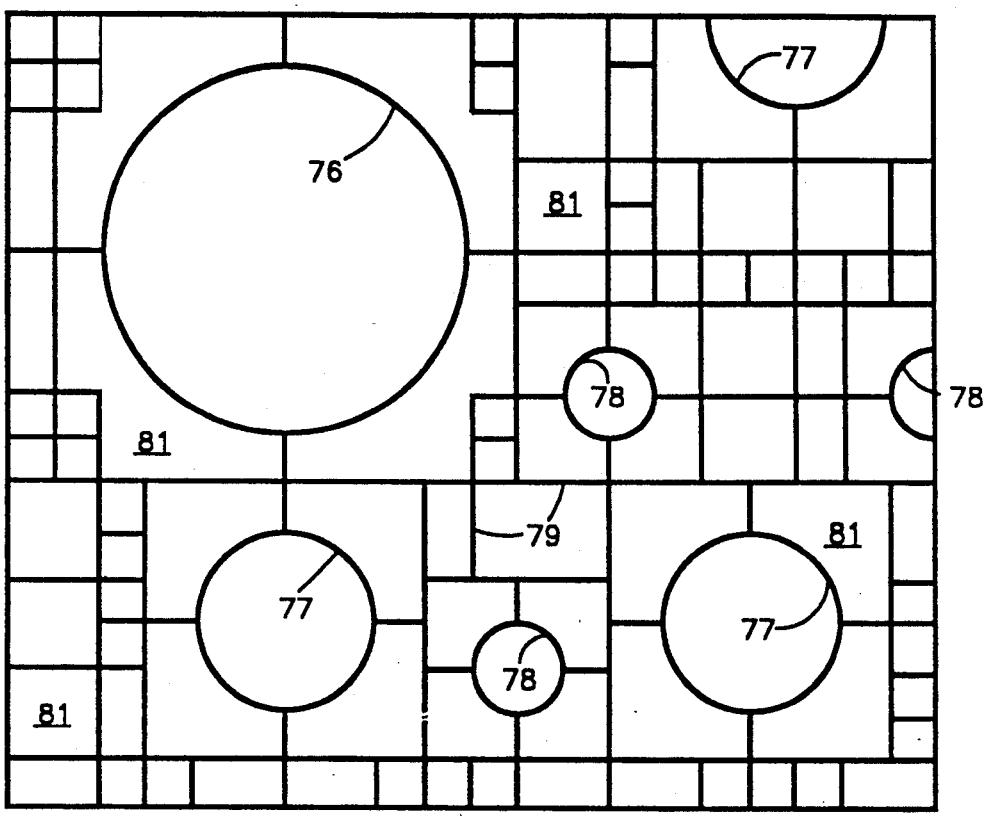
FIG. 10 illustrates one decorative design of a suspension ceiling combining curved grid tees of different radii of curvature combined with straight grid tees to form a complete grid.
Figure 10A:
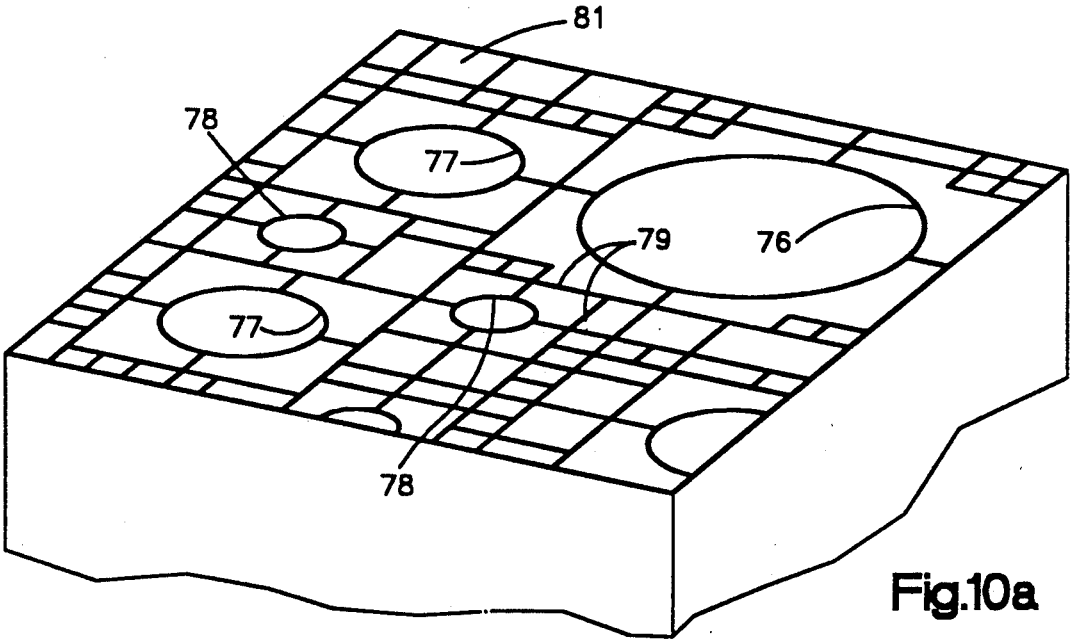
FIG. 10*a* is a perspective view of the suspension ceiling of FIG. 10.

FIGS. 10 and 10*a* illustrate an example of a pattern that can be provided in an entire grid. In such grid assembly, curved grid tees 76 are assembled to produce a relatively large diameter circle and curved grid tees 77 and assembled to provide circles and a semicircle of a smaller diameter. Further, curved grid tees 78 having a further reduced radius of curvature are assembled to form still smaller circles and a smaller semicircle. These curved grid tees are interconnected by straight grid tees 79 to complete a very attractive grid pattern. In such a ceiling, panels 81 are positioned in the openings defined by the grid tees. In each instance, the panel is shaped along its periphery to match the shape of the openings so that each panel is properly supported by the flanges extending around the periphery of the openings. Further, in some instances, various types of lighting fixtures are provided in some of the openings to further enhance the appearance of the ceiling.

Further, in some instances, a grid may be suspended without panels or with panels positioned in some of the openings. Also, the use of colored panels in some or all openings provided an attractive appearance which may simulate stained glass ceiling. Still further, non-planar panels may be installed to provide depth to the ceiling.

Figure 11:
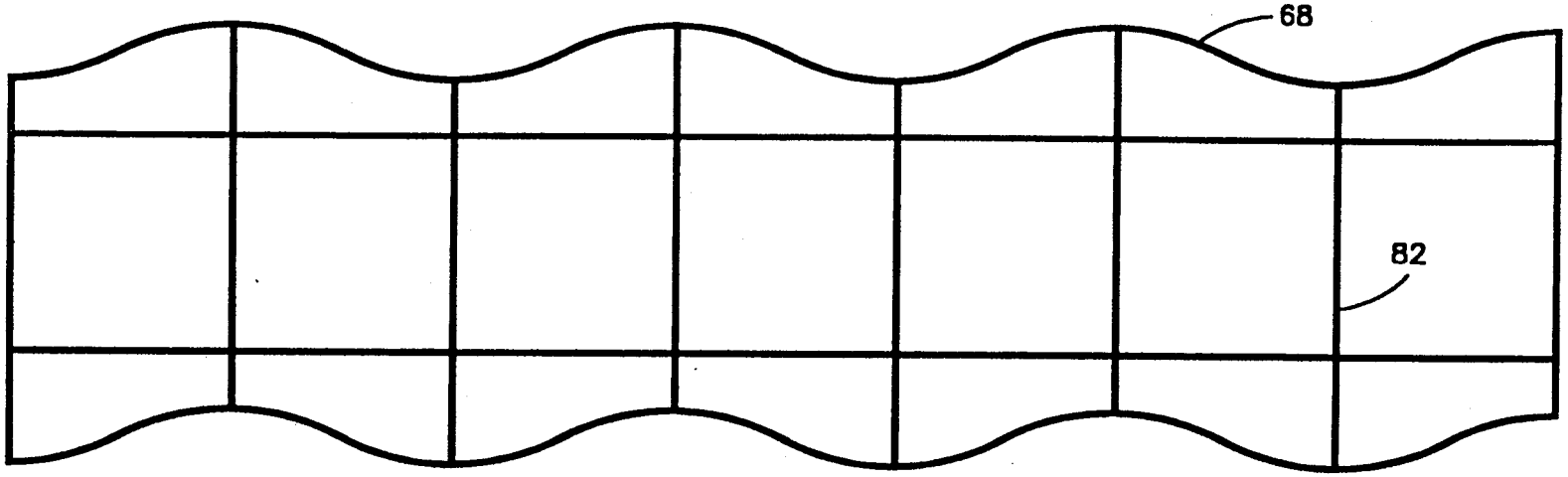
FIG. 11 is a fragmentary plan view of another decorative form of suspension ceiling combining curved and straight grid tees.
Figure 11A:
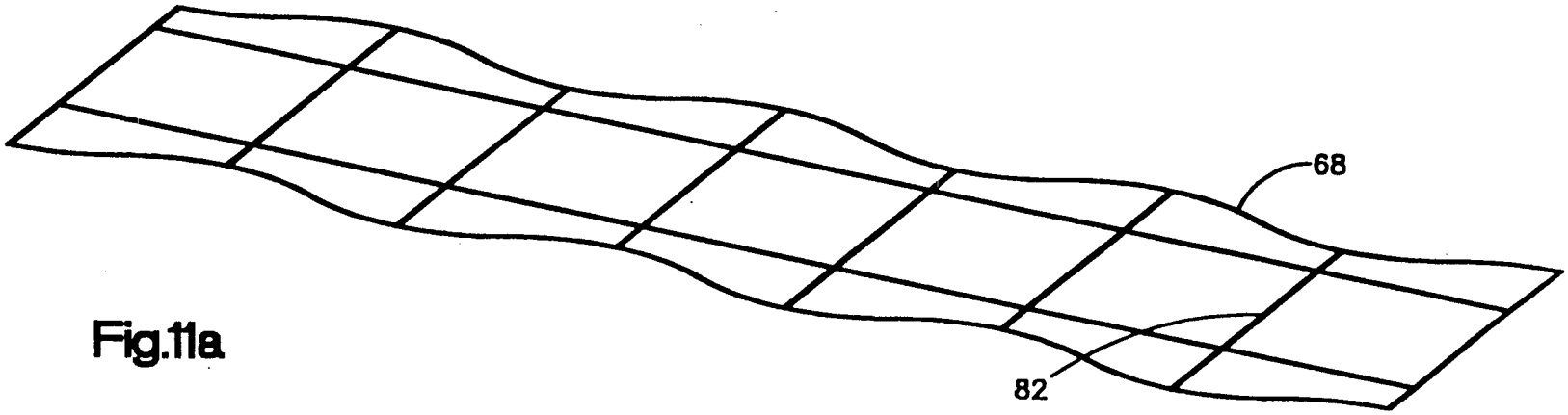
FIG. 11*a* is a perspective view of the ceiling illustrated in FIG. 11.

FIGS. 11 and 11*a* illustrate a portion of another form of grid which may be assembled with the curved grid tees incorporating the present invention in combination with straight grid tees. In this instances, grid tees 68 of the type illustrated in FIG. 9*b* are assembled with straight grid tees 82 to produce to wavelike appearance in the assembled grid. Here again, appropriately shaped panels are often installed in the openings to complete the ceiling.

Figure 12:
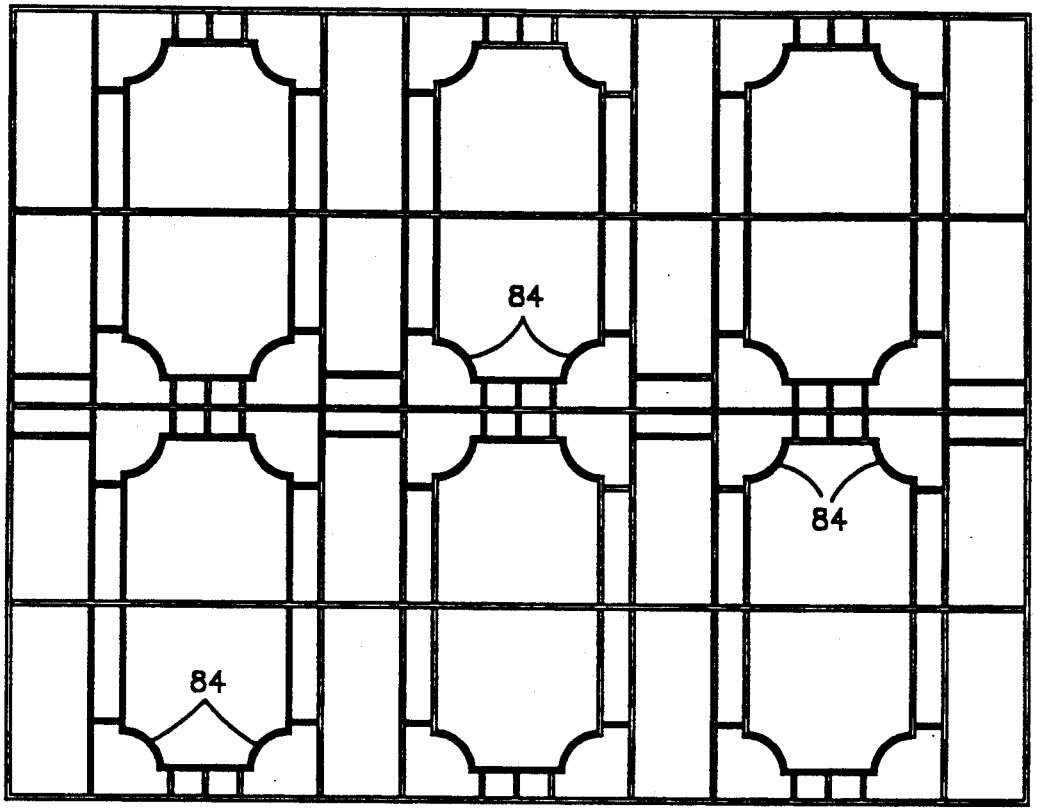
FIG. 12 illustrates another decorative form of suspension ceiling combining curved and straight grids.
Figure 12A:
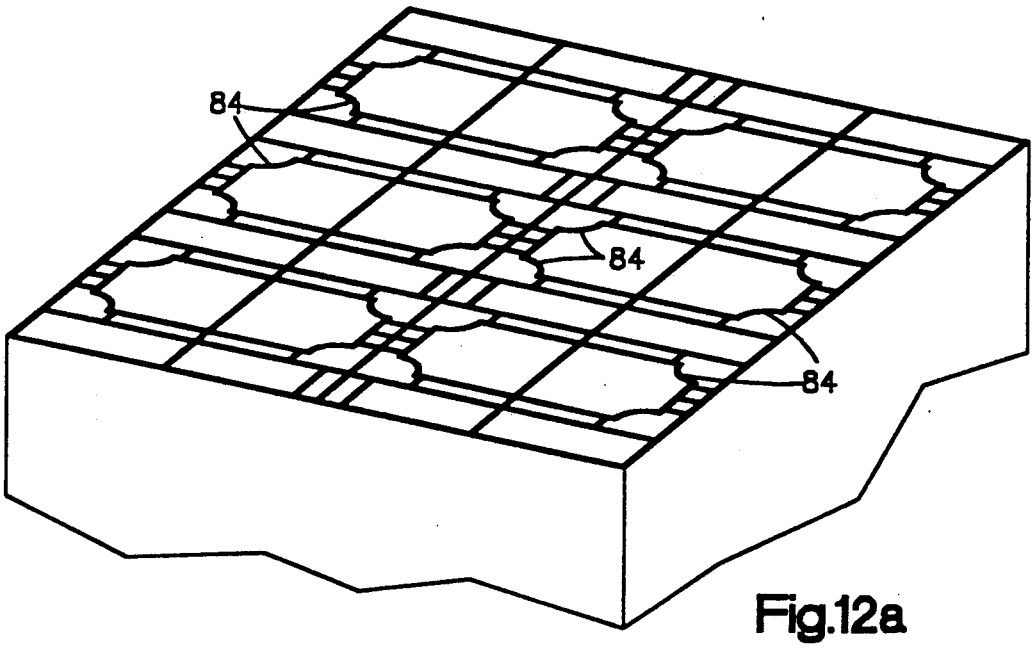
FIG. 12*a* is a perspective view of the suspension ceiling illustrated in FIG. 12.

FIGS. 12 and 12*a* illustrate still another example of a decorative ceiling grid which may be produced by combining curved grid tees in accordance with the present invention with straight grid tees. In this instance, grid tees 84, which extend through a 90-degree arc, are interconnected with straight grid tees to provide another decorative and aesthetically pleasing ceiling grid structure.

Figure 13:
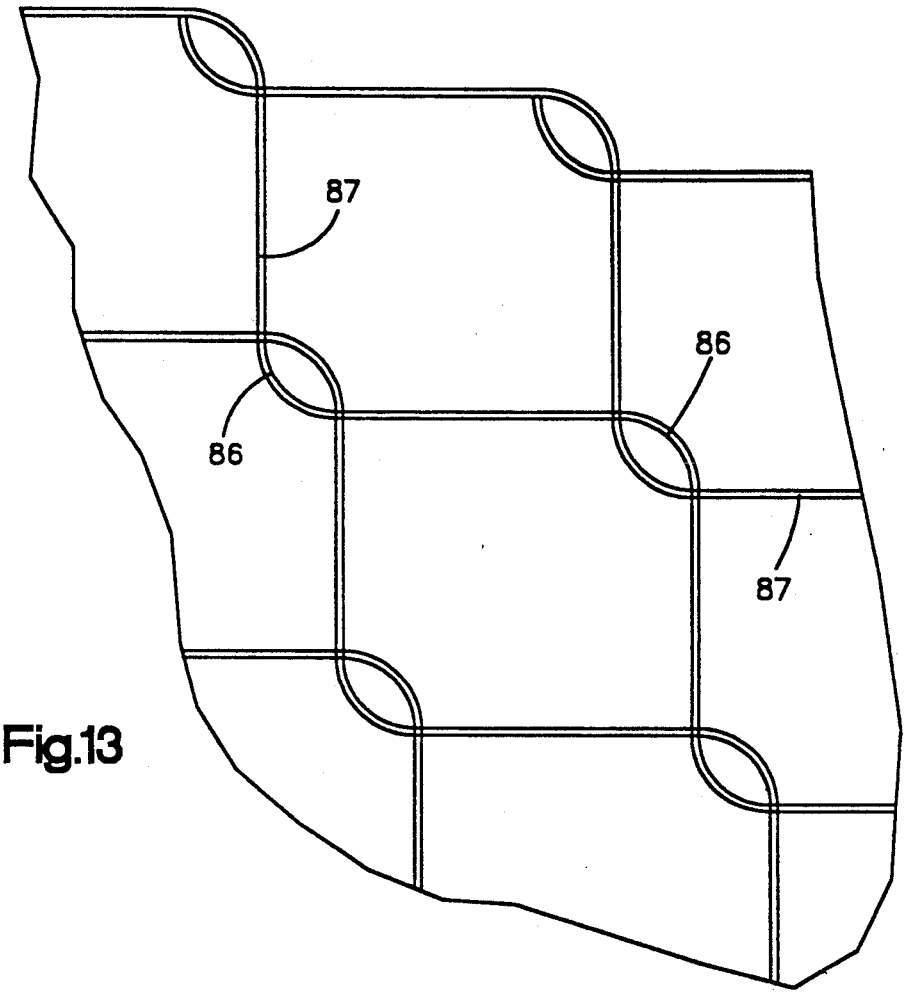
FIG. 13 illustrates a portion of another decorative suspension ceiling combining curved and straight grid tees.
Figure 13A:
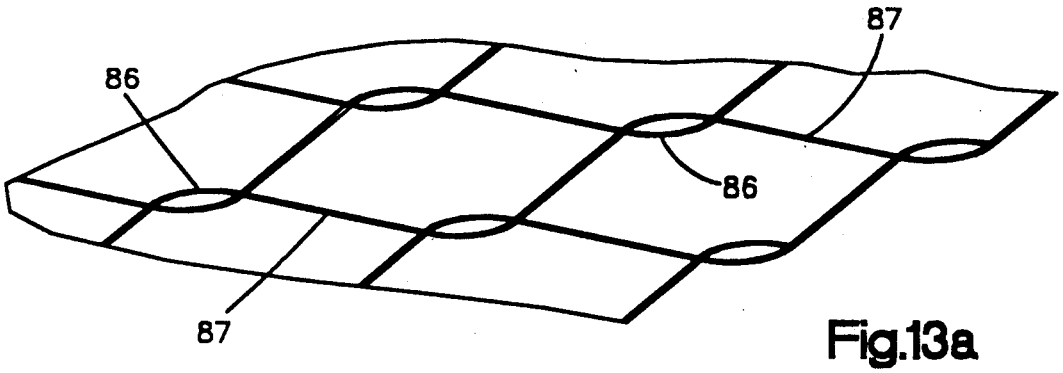
FIG. 13*a* is a fragmenatry, perspective view of the ceiling illustrated in FIG. 13.

Finally, FIGS. 13 and 13*a* illustrate another example of a decorative ceiling grid which can be produced by combining curved grid tees 86 which extend through a 90-degree arc with straight grid tees 87.

These illustrated examples of assembled grids which can be produced with curved and straight grid tees are given herein only as examples of the extremely large number of attractive ceilings which can be achieved with suspension ceiling grids employing curved grid tees incorporating the present invention. Since the curvature of the curved grid tees is in a direction parallel to the plane of the exposed flanges of the curved grid tees, a completely planar, assembled grid can be provided in accordance with the present invention. Further, since the exposed surface of the flanges of such curved grid tees remains completely smooth and planar, the curved grid tees blend in with the straight grid tees to form a very attractive grid assembly.

Although the illustrated grid tees provide a central web with a bulb along one edge and flanges along the opposite edge, which is a typical grid tee section, this invention is applicable to other cross sections. For example, the grid element can be formed without a bulb or with flanges along both edges of the web. As used herein, the terms "grid tees" or "tees" are intended to include elements with or without stiffening bulbs and also elements having flanges along both edges of the web.

The curved nature of the grid tees tends to produce lateral stability. Therefore, in many instances, the grid can be partially assembled on a flat surface or floor and then lifted into position, where it is suspended by wires. Consequently, the process of installation, in many instances, is no more difficult than the installation of grids from straight elements.

Although the preferred embodiment of this invention has been shown and described, it should be understood that various modifications and rearrangements of the parts may be resorted to without departing from the scope of the invention as disclosed and claimed herein.

What is claimed is:

1. A curved grid tee comprising an elongated metal strip providing a central web and planar flange portions extending along a plane in opposite directions from one edge of said web, said grid tee being initially straight and being bent and curved in a direction parallel to the plane of said flanges causing compressive stresses and reducing the initial length of the metal forming the inner of said flange portions and tensile stresses and stretching the metal forming the outer of said flange portions, and connector means on said grid tee for connecting said grid tee with other grid tees to form a ceiling grid.

2. A curved grid tee as set forth in claim 1, including a metal strip cap underlying said flange portions and secured thereto by reverse bends embracing the edges of said flange portion, said cap providing a smooth planar exposed surface.

3. A curved grid tee as set forth in claim 2, wherein said strip cap provides an exposed undamaged painted surface which was painted prior to the forming of said grid tee into a curve.

4. A curved grid tee as set forth in claim 2, wherein the edge of said strip cap along said inner flange portion has small wrinkles on the same side of said inner flange portion as said central web.

5. A curved grid tee as set forth in claim 1, wherein said connector means includes end connectors on the ends of said grid tees.

6. A curved grid tee as set forth in claim 1, wherein said metal strip provides laterally extending stiffening means along the edge of said central web opposite said flange portions.

7. A curved grid tee as set forth in claim 6, wherein said stiffening means includes a hollow bulb along the edge of said central web remote from said flange portions.

8. A curved grid tee for suspension ceilings comprising an elongated central web, a stiffening bulb along one longitudinal edge of said web, and oppositely extending planar flange portions along the opposite longitudinal edge of said web, said grid tee being curved in a direction parallel to the plane of said flange portions.

9. A curved grid tee as set forth in claim 8, wherein said grid tee is formed of at least two strips of metal and provides flange extremities having four layers of metal.

10. A curved grid tee as set forth in claim 9, wherein said bulb is hollow.

11. A curved grid tee as set forth in claim 10, wherein said web provides means to center ceiling panels in openings of a grid of a suspension ceiling defined at least in part by said curved grid tee.

12. A suspension ceiling comprising a plurality of interconnected grid tees having a central vertically extending web and a planar flange extending laterally in both directions from the lower portion of said web, said grid tees cooperating to define a plurality of openings surrounded by said flanges of adjacent grid tees, and ceiling panels in said openings supported along their peripheries by the adjacent of said flanges, at least some of said grid tees being curved in a direction parallel to the plane of their said flanges while providing a smooth lower flange surface, said panels positioned in openings bounded by said curved tees providing mating curved peripheries along said curved grid tees.

13. A suspension ceiling as set forth in claim 12, wherein said curved grid tees are formed by bending straight grid tees causing the inner portions of said curved grid tee flange to be compressed in the outer portions thereof to be stretched.

14. A suspension ceiling as set forth in claim 12, wherein said curved grid tees are formed with centering means centering associated panels in said openings defined at least in part by said curved grid tees.

15. A suspension ceiling as set forth in claim 12, wherein at least some of said grid tees are straight grid tees.

16. A suspension ceiling as set forth in claim 12, wherein said curved grid tees are formed with connector openings intermediate the length of said web, and at least some of said grid tees associated therewith provide end connectors positioned in said openings and providing a connection therewith.

17. A curved grid tee as set forth in claim 1 wherein said grid tee is adapted to be assembled in a suspension ceiling grid system to form a closed circular grid opening.

18. A curved grid tee as set forth in claim 17 wherein said curved grid tee is provided with end connectors operable to interconnect adjacent ends of grid tees at locations spaced from grid intersections.

19. A suspension ceiling as set forth in claim 12 wherein at least some of said curved grid tees form circular openings.

20. A suspension ceiling as set forth in claim 19 wherein said at least some of said grid tees provide connectors connecting adjacent ends thereof at locations spaced from grid intersections.

* * * * *